US007427065B2

(12) United States Patent
Maruyama

(10) Patent No.: US 7,427,065 B2
(45) Date of Patent: Sep. 23, 2008

(54) PRINTER

(75) Inventor: Takahito Maruyama, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 303 days.

(21) Appl. No.: 11/235,003

(22) Filed: Sep. 22, 2005

(65) Prior Publication Data

US 2006/0180971 A1 Aug. 17, 2006

(30) Foreign Application Priority Data

Sep. 27, 2004 (JP) ..... 2004-279259

(51) Int. Cl.
*B65H 5/06* (2006.01)

(52) U.S. Cl. ..... 271/273; 271/272; 271/274

(58) Field of Classification Search ..... 271/272, 271/264, 273, 274, 266
See application file for complete search history.

(56) References Cited

U.S. PATENT DOCUMENTS 7,090,215 B2 * 8/2006 Mandel et al. ..... 271/273
7,123,341 B2 * 10/2006 Ono ..... 355/27

FOREIGN PATENT DOCUMENTS

JP 7-214843 8/1995
JP 8-72335 3/1996

* cited by examiner

*Primary Examiner*—Kaitlin S Joerger
(74) *Attorney, Agent, or Firm*—Brinks Hofer Gilson & Lione

(57) ABSTRACT

A sheet-feeding mechanism of a printer conveys a recording sheet nipped between a first sheet-feeding roller and a first pressing roller towards a thermal head. At the start of a printing operation, a second pressing roller is disposed distant from a second sheet-feeding roller. When a front end of the recording sheet being printed is conveyed to a space between the second sheet-feeding roller and the second pressing roller disposed distant from each other, the second pressing roller gradually comes into press-contact with the recording sheet such that the recording sheet being printed is conveyed downstream by at least a second sheet-feeding unit. The first pressing roller is gradually shifted away from the recording sheet before a rear end of the recording sheet being printed is released from the nip between the first sheet-feeding roller and the first pressing roller.

3 Claims, 5 Drawing Sheets

PRINTING MODE

BACK-FEEDING MODE

PRINTER

BACKGROUND OF THE INVENTION

1. Field of the Invention

The present invention relates to sheet-feeding mechanisms of printers, and particularly, to a sheet-feeding mechanism of a printer that conveys a recording sheet with high accuracy to print a high-quality image.

2. Description of the Related Art

A conventional sheet-feeding mechanism of a printer will be described with reference to FIGS. 7 and 8. Japanese Unexamined Patent Application Publication No. 2002-144616 discloses an example of a printer 31 equipped with a conventional sheet-feeding mechanism. The printer 31 is, for example, a thermal-transfer printer and includes a platen roller 32 and a thermal head 34 that is press-contactable with the platen roller 32 via a recording sheet 33. The recording sheet 33 and the thermal head 34 have an ink ribbon (not shown) extending therebetween.

A first sheet-feeding roller 35 and a first pressing roller 36 defining a sheet-feeding unit are disposed upstream of the thermal head 34 with respect to a direction in which the recording sheet 33 being printed is conveyed, as indicated by an arrow A. The first sheet-feeding roller 35 and the first pressing roller 36 are capable of coming into and out of contact with each other. On the other hand, a second sheet-feeding roller 37 and a second pressing roller 38 are disposed downstream of the thermal head 34 such that the second sheet-feeding roller 37 and the second pressing roller 38 are capable of coming into and out of contact with each other.

When the recording sheet 33 is nipped between the first pressing roller 36 and the first sheet-feeding roller 35 rotating counterclockwise, the recording sheet 33 is conveyed in the direction of the arrow A and thus becomes nipped between the thermal head 34 in a head-down state and the platen roller 32.

In this state, a plurality of heater elements (not shown) included in the thermal head 34 is selectively heated to heat-transfer the ink in the ink ribbon to the recording sheet 33. As a result, a predetermined image is printed on the recording sheet 33.

A front end 33*a* of the recording sheet 33 conveyed in the direction of the arrow A in the printing process pushes upward the second pressing roller 38 in press-contact with the second sheet-feeding roller 37 as shown with a double-dashed line. Thus, the recording sheet 33 becomes nipped between the second pressing roller 38 and the second sheet-feeding roller 37 rotating counterclockwise, whereby the predetermined image is printed on the top surface of the recording sheet 33.

However, during the printing process in a conventional sheet-feeding mechanism of a printer, the recording sheet 33 being printed is stopped momentarily while the front end 33*a* of the recording sheet 33 formed of heavy paper hits against the second sheet-feeding roller 37 and the second pressing roller 38 in order to push the second pressing roller 38 upward.

This may possibly produce an undesirable line in a section of the printed image corresponding to where the recording sheet 33 is momentarily stopped since the ink in the ink ribbon is transferred to that section in a partially overlapping manner.

On the other hand, referring to FIG. 8, while the recording sheet 33 nipped between the second sheet-feeding roller 37 and the second pressing roller 38 is being conveyed in the direction of the arrow A during the printing process, the nipping force of the first sheet-feeding roller 35 and the first pressing roller 36 is released from a rear end 33*b* of the recording sheet 33. In this case, the rear end 33*b* momentarily slides on the outer periphery surfaces of the first sheet-feeding roller 35 and the first pressing roller 36, such that the rear end 33*b* of the recording sheet 33 being conveyed in the direction of the arrow A is momentarily pushed in the direction of the arrow A by a small amount.

This temporarily increases the conveying rate of the recording sheet 33 being printed, which may produce a white line in a section of the printed image where the ink in the ink ribbon is not transferred.

SUMMARY OF THE INVENTION

Accordingly, it is an object of the present invention to provide a sheet-feeding mechanism of a printer that can perform a high-quality image-printing operation without forming, for example, white lines on the printed image.

In order to achieve the aforementioned object, the present invention provides a sheet-feeding mechanism of a printer, which includes a first sheet-feeding unit including a first sheet-feeding roller and a first pressing roller that is press-contactable with the first sheet-feeding roller; a second sheet-feeding unit including a second sheet-feeding roller and a second pressing roller that is press-contactable with the second sheet-feeding roller; a recording sheet which is conveyable by being nipped between the first sheet-feeding roller and the first pressing roller and between the second sheet-feeding roller and the second pressing roller and by rotating the first and second sheet-feeding rollers; and a printing unit which is capable of printing a predetermined image on the recording sheet. The first sheet-feeding unit is disposed upstream of the printing unit with respect to a direction in which the recording sheet is conveyed during a printing operation. The second sheet-feeding unit is disposed downstream of the printing unit with respect to the conveying direction of the recording sheet. The second pressing roller is disposed distant from the second sheet-feeding roller at the start of the printing operation, the start of the printing operation being a state where the recording sheet nipped between the first sheet-feeding unit and the first pressing roller is conveyed to the printing unit. When a front end of the recording sheet being printed is conveyed to a space between the second sheet-feeding roller and the second pressing roller disposed distant from each other, the second pressing roller gradually comes into press-contact with the recording sheet such that the recording sheet being printed is conveyed downstream by at least the second sheet-feeding unit, and the first pressing roller is gradually shifted away from the recording sheet before a rear end of the recording sheet being printed passes the first sheet-feeding unit.

Furthermore, when the printing operation performed on the recording sheet conveyed downstream by the second sheet-feeding unit is completed, the second sheet-feeding roller may be reversely rotated in order to back-feed the recording sheet upstream. Moreover, when the recording sheet is back-fed to a space between the first sheet-feeding roller and the first pressing roller disposed distant from each other, the first pressing roller may gradually come into press-contact with the recording sheet such that the recording sheet is back-fed by at least the first sheet-feeding unit. The second pressing roller may be gradually shifted away from the recording sheet before the front end of the recording sheet being back-fed passes the second sheet-feeding unit. The front end in this case refers to a trailing end in view of the back-feeding operation.

Furthermore, the first and second pressing rollers may gradually come into and out of press-contact with the first and second sheet-feeding rollers, respectively, via corresponding cams.

Furthermore, the first and second pressing rollers are preferably linked to corresponding levers that slide on outer periphery surfaces of the corresponding cams.

Furthermore, the first and second pressing rollers, which are shiftable away from the recording sheet being conveyed, are preferably capable of being shifted away from the respective first and second sheet-feeding rollers by a distance greater than a thickness of the recording sheet.

Furthermore, a driving source of the first and second sheet-feeding rollers is preferably defined by a stepper motor, and a conveying distance of the recording sheet is preferably controllable by adjusting the number of steps of the stepper motor.

In the sheet-feeding mechanism of the printer according to the present invention, when the front end of the recording sheet being printed is conveyed to the space between the second sheet-feeding roller and the second pressing roller disposed distant from each other, the second pressing roller gradually comes into press-contact with the recording sheet such that the recording sheet being printed is conveyed downstream by at least the second sheet-feeding unit. On the other hand, the first pressing roller is gradually shifted away from the recording sheet before the rear end of the recording sheet being printed passes the first sheet-feeding unit. Accordingly, this prevents the recording sheet being conveyed in the printing process from stopping temporarily, thereby preventing printing errors such as an undesirable line on the printed image.

On the other hand, when the recording sheet is back-fed to the space between the first sheet-feeding roller and the first pressing roller disposed distant from each other, the first pressing roller gradually comes into press-contact with the recording sheet such that the recording sheet is back-fed by at least the first sheet-feeding unit. The second pressing roller is gradually shifted away from the recording sheet before the front end (i.e. the trailing end in view of the back-feeding process) of the recording sheet being back-fed passes the second sheet-feeding unit. Accordingly, this achieves a smooth back-feeding operation of the recording sheet.

Furthermore, the first and second pressing rollers gradually come into and out of press-contact with the first and second sheet-feeding rollers, respectively, via the corresponding cams. Accordingly, the gradual in-contact and out-of-contact processes of the first and second pressing rollers can be properly performed, thereby achieving a smooth conveying operation.

Moreover, since the first and second pressing rollers are linked to the corresponding levers that slide on the outer periphery surfaces of the corresponding cams, the rotation of the cams can be properly transmitted to the first and second pressing rollers via the levers. Accordingly, the gradual in-contact and out-of-contact processes of the first and second pressing rollers can be properly performed.

Furthermore, due to the fact that the first and second pressing rollers, which are shiftable away from the recording sheet being conveyed, are capable of being shifted away from the respective first and second sheet-feeding rollers by a distance greater than the thickness of the recording sheet, the recording sheet being conveyed during the printing operation or the recording sheet being back-fed after the printing operation can be fed or be back-fed smoothly at a constant rate.

Furthermore, the driving source of the first and second sheet-feeding rollers is defined by a stepper motor, and the conveying distance of the recording sheet is controllable by adjusting the number of steps of the stepper motor. Consequently, this eliminates the need for, for example, a sensor that detects the positioning of the recording sheet, thereby contributing to cost reduction.

DESCRIPTION OF THE PREFERRED EMBODIMENTS

Figure 1:
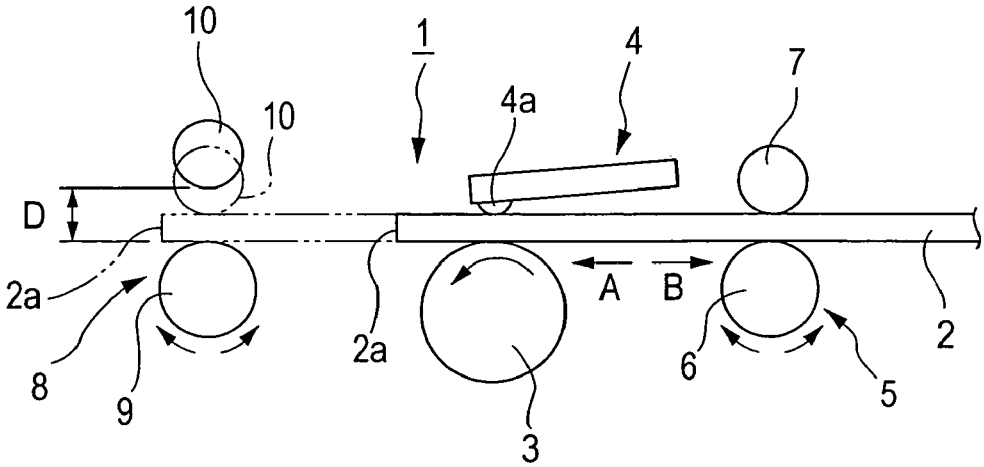
FIG. 1 illustrates a state in which a recording sheet is being conveyed by a sheet-feeding mechanism of a printer according to the present invention.
Figure 2:
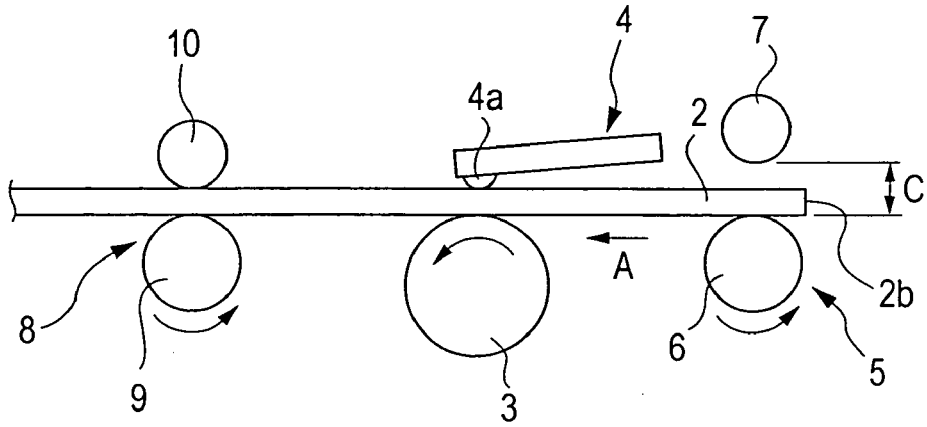
FIG. 2 illustrates another state in which the recording sheet is being conveyed by the sheet-feeding mechanism of the printer according to the present invention.
Figure 3:
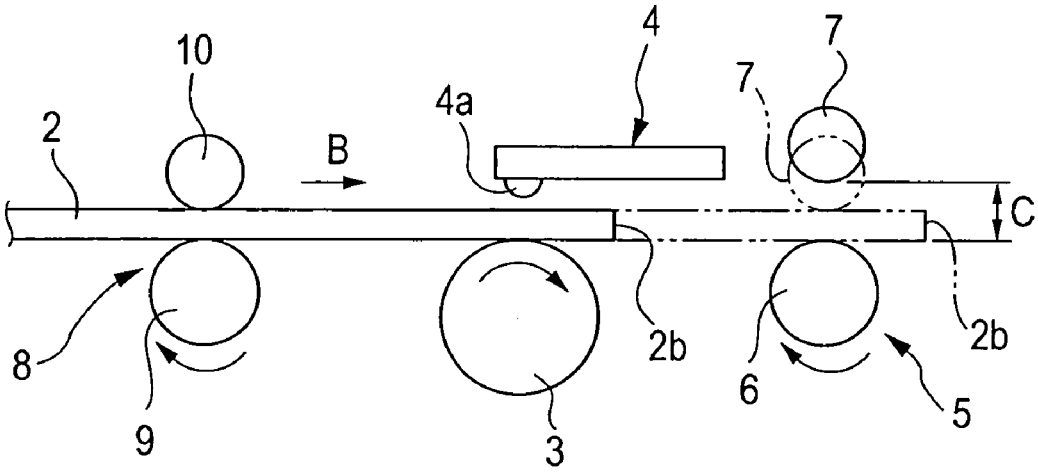
FIG. 3 is a schematic diagram illustrating a back-feeding operation of the recording sheet performed by the sheet-feeding mechanism of the printer according to the present invention.
Figure 4:
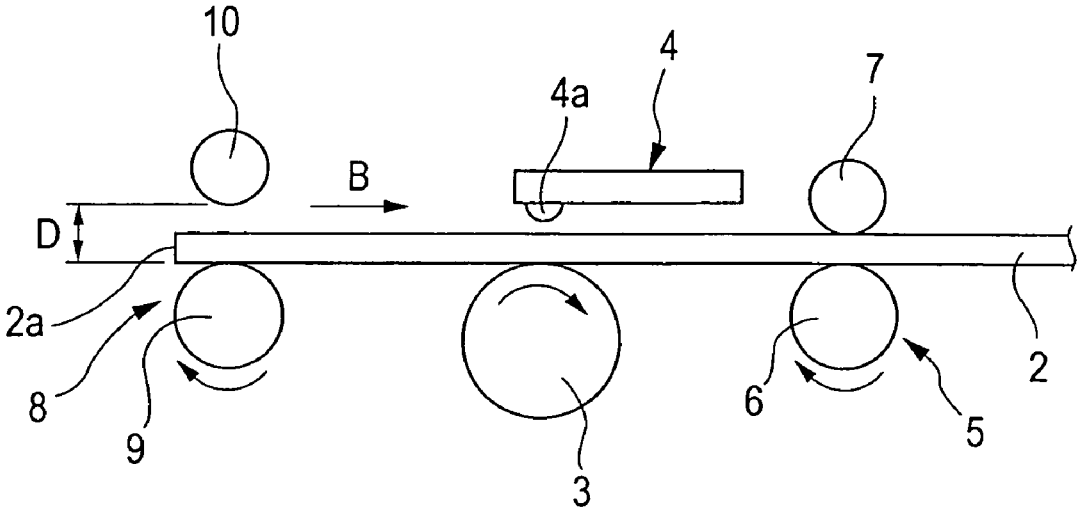
FIG. 4 is another schematic diagram illustrating the back-feeding operation of the recording sheet performed by the sheet-feeding mechanism of the printer according to the present invention.
Figure 5:
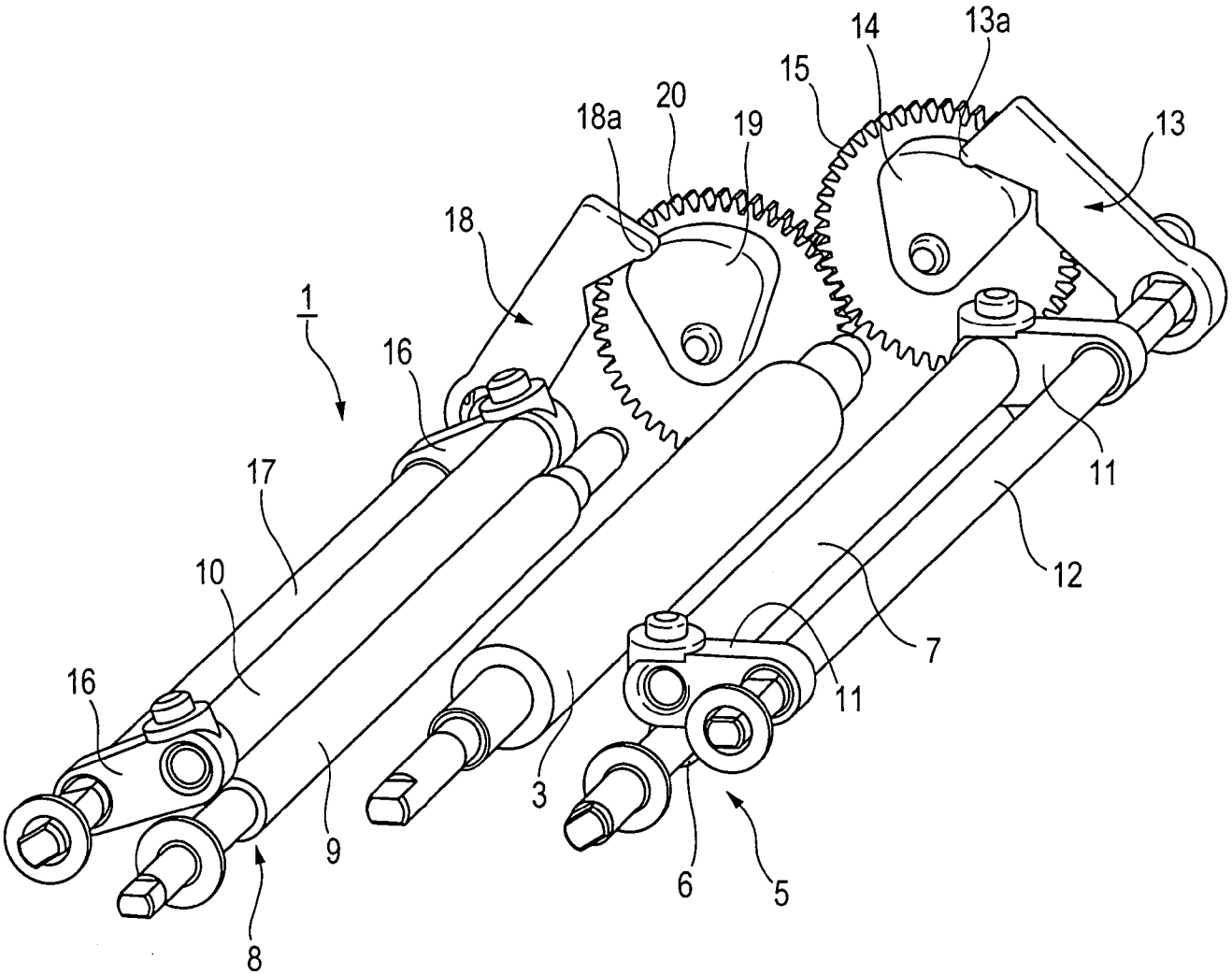
FIG. 5 is a perspective view of the sheet-feeding mechanism of the printer according to the present invention.
Figure 6A:
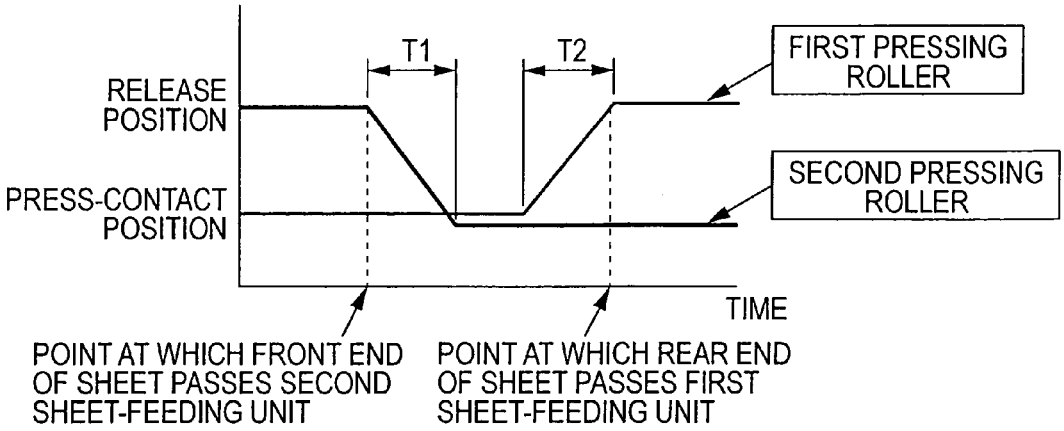
FIGS. 6A and 6B are graphs illustrating operations of first and second pressing rollers according to the present invention during a conveying process of the recording sheet.
Figure 6B:
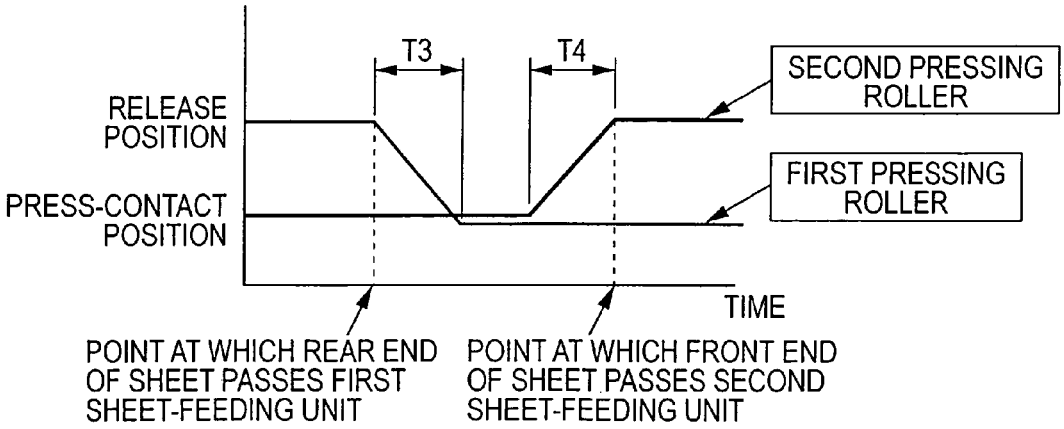
Figure 7:
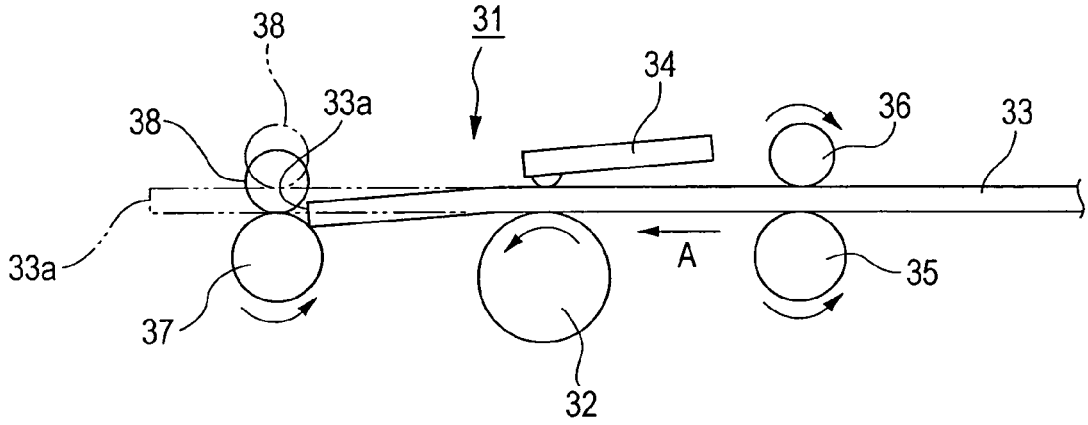
FIG. 7 PRIOR ART
FIG. 7 illustrates a state in which a recording sheet is being conveyed by a conventional sheet-feeding mechanism of a printer.
Figure 8:
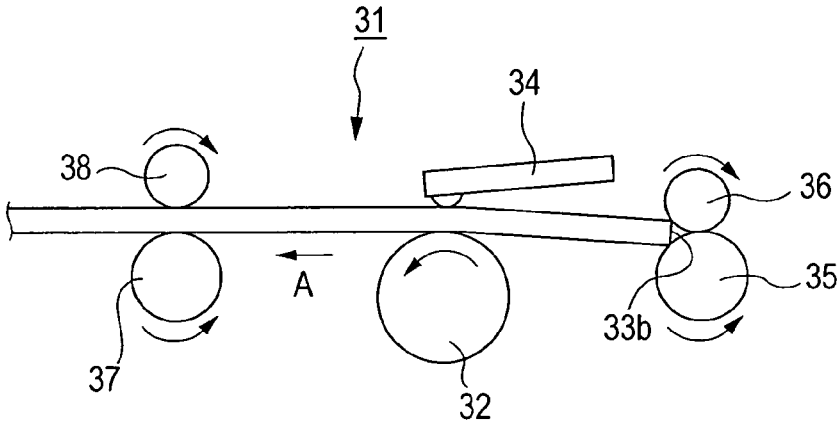
FIG. 8 PRIOR ART
FIG. 8 illustrates another state in which the recording sheet is being conveyed by the conventional sheet-feeding mechanism of the printer.

A sheet-feeding mechanism of a printer according to an embodiment of the present invention will now be described with reference to FIGS. 1 to 4. FIGS. 1 and 2 illustrate a conveying operation of a recording sheet during a printing mode. FIGS. 3 and 4 schematically illustrate a back-feeding operation of the recording sheet. FIG. 5 is a perspective view illustrating the sheet-feeding mechanism of the printer according to the present invention. FIGS. 6A and 6B are graphs illustrating operations of first and second pressing rollers according to the present invention during the conveying operation of the recording sheet.

A sheet-feeding mechanism 1 of a printer according to the present invention is used in, for example, a thermal-transfer printer. Referring to FIGS. 1 and 2, the sheet-feeding mechanism 1 has a conveying path through which a recording sheet 2 formed of heavy paper, such as photographic printing paper, is conveyed. A columnar platen roller 3 is rotatably disposed in this conveying path.

Moreover, a thermal head 4 defining a printing unit is provided above and facing the platen roller 3. The thermal head 4 includes a plurality of heater elements 4*a* which are arranged parallel to the longitudinal direction of the platen roller 3 and are capable of moving into and out of contact with the platen roller 3. Furthermore, the platen roller 3 and the thermal head 4 have an ink ribbon (not shown) extending therebetween.

Furthermore, a first sheet-feeding unit 5 is disposed upstream of the thermal head 4 defining the printing unit with respect to a conveying direction of recording sheet 2 indicated by an arrow A. The first sheet-feeding unit 5 includes a first sheet-feeding roller 6 which defines a lower portion of the first sheet-feeding unit 5 and can be rotated clockwise and counterclockwise; and a first pressing roller 7 which is rotatably disposed above the first sheet-feeding roller 6 in a manner such that the first pressing roller 7 is press-contactable with the first sheet-feeding roller 6.

Since the first sheet-feeding roller 6 is rotatable clockwise and counterclockwise, the recording sheet 2 disposed between the first sheet-feeding roller 6 and the first pressing roller 7 can be fed in the direction of the arrow A, or can be back-fed in a direction indicated by an arrow B.

The first pressing roller 7 can be slowly lifted away from the first sheet-feeding roller 6 such that a dimension C between the first pressing roller 7 and the first sheet-feeding roller 6 can be made greater than the thickness of the recording sheet 2. In other words, the first pressing roller 7 can gradually move out of press-contact with the recording sheet 2.

On the other hand, the first pressing roller 7 separated from the first sheet-feeding roller 6 by the dimension C can be slowly lowered so as to come into press-contact with the first sheet-feeding roller 6.

In other words, the first pressing roller 7 is capable of gradually coming into press-contact with the recording sheet 2.

On the other hand, a second sheet-feeding unit 8 is disposed downstream of the thermal head 4 with respect to the conveying direction of recording sheet 2 indicated by the arrow A. The second sheet-feeding unit 8 includes a second sheet-feeding roller 9 which defines a lower portion of the second sheet-feeding unit 8 and can be rotated clockwise and counterclockwise like the first sheet-feeding roller 6; and a second pressing roller 10 which is rotatably disposed above the second sheet-feeding roller 9 in a manner such that the second pressing roller 10 is press-contactable with the second sheet-feeding roller 9.

The second sheet-feeding roller 9 and the second pressing roller 10 nip the recording sheet 2 therebetween so as to convey the recording sheet 2 in the direction of the arrow A or back-feed the recording sheet 2 in the direction of the arrow B.

The second pressing roller 10 can be slowly lifted away from the second sheet-feeding roller 9 such that a dimension D between the second pressing roller 10 and the second sheet-feeding roller 9 can be made greater than the thickness of the recording sheet 2. In other words, the second pressing roller 10 can gradually move out of press-contact with the recording sheet 2.

On the other hand, the second pressing roller 10 separated from the second sheet-feeding roller 9 by the dimension D can be slowly lowered so as to come into press-contact with the second sheet-feeding roller 9. In other words, the second pressing roller 10 is capable of gradually coming into press-contact with the recording sheet 2.

The first and second pressing rollers 7, 10 gradually come into or out of press-contact with the recording sheet 2 so as to prevent a drastic increase or a drastic decrease in the conveying load applied to the recording sheet 2 being conveyed.

Consequently, this prevents the recording sheet 2 being conveyed from stopping temporarily or from moving temporarily at a faster rate.

On the other hand, the first and second sheet-feeding rollers 6, 9 are driven by the same driving source defined by a stepper motor (not shown). The conveying distance of the recording sheet 2 is controllable by adjusting the number of steps of the stepper motor.

Referring to FIG. 5, the first pressing roller 7 of the first sheet-feeding unit 5 is pivotally linked to a driving shaft 12 via a pair of linking arms 11. One end of the driving shaft 12 distant from the viewer of FIG. 5 has a first plate-like lever 13 attached thereto. An end portion of the first lever 13 is provided with a cam-sliding portion 13*a*.

Furthermore, a first gear 15 integrated with a first cam 14 via, for example, an adhesive or a screw, is disposed adjacent to the cam-sliding portion 13*a* of the first lever 13. The first gear 15 is meshed with a driving gear (now shown).

By rotating the driving gear, the first gear 15 is rotated, which in turn rotates the first cam 14. The cam-sliding portion 13*a* of the first lever 13 slides on the outer periphery surface of the first cam 14 so as to allow the first pressing roller 7 to come into or out of contact with the first sheet-feeding roller 6.

On the other hand, the second pressing roller 10 of the second sheet-feeding unit 8 is pivotally linked to a driving shaft 17 via a pair of linking arms 16. One end of the driving shaft 17 distant from the viewer of FIG. 5 has a second plate-like lever 18 attached thereto. An end portion of the second lever 18 is provided with a cam-sliding portion 18*a*.

Furthermore, a second gear 20 integrated with a second cam 19 is disposed adjacent to the cam-sliding portion 18*a* of the second lever 18. The second gear 20 is meshed with the first gear 15, such that the second gear 20 rotates in response to the rotation of the first gear 15.

Specifically, by rotating the driving gear, the second gear 20 is rotated, which in turn rotates the second cam 19. The cam-sliding portion 18*a* of the second lever 18 slides on the outer periphery surface of the second cam 19 so as to allow the second pressing roller 10 to come into or out of contact with the second sheet-feeding roller 9.

An operation of the sheet-feeding mechanism 1 of the printer according to the present invention will now be described. Firstly, referring to FIG. 1, the first pressing roller 7 of the first sheet-feeding unit 5 is pivotally moved counterclockwise. Thus, the first pressing roller 7 and the first sheet-feeding roller 6 nip the recording sheet 2 therebetween so as to convey the recording sheet 2 downstream in the direction of the arrow A. During the downstream conveying process of the recording sheet 2, the first sheet-feeding roller 6 is rotated counterclockwise, and the second sheet-feeding roller 9 is also rotated simultaneously in the same direction.

Subsequently, when a front end 2*a* of the recording sheet 2 becomes nipped between the thermal head 4 in a head-down state and the platen roller 3, the heater elements 4*a* of the thermal head 4 are selectively heated based on print data.

Thus, the ink in the ink ribbon is selectively heat-transferred to the recording sheet 2, whereby a printing operation of a predetermined image is performed starting from the front end 2*a* of the recording sheet 2.

Subsequently, the recording sheet 2 being printed is conveyed in the direction of the arrow A by a predetermined distance in phase with the number of steps of the driving source for the first sheet-feeding roller 6, such as the stepper motor. When the number of steps of the stepper motor reaches a predetermined value, the front end 2*a* of the recording sheet 2 is conveyed to a space between the second sheet-feeding roller 9 and the second pressing roller 10 separated from each other by the dimension D. Subsequently, the driving gear (not shown) is rotated, which in turn rotates the first and second gears 15, 20. This allows the cam-sliding portion 18*a* of the second lever 18 to slide on the outer periphery surface of the second cam 19, whereby the second pressing roller 10 disposed at a position corresponding to the dimension D is slowly lowered.

The recording sheet 2 conveyed to the second sheet-feeding unit 8 then gradually comes into press-contact with the second sheet-feeding roller 9 so as to reach the state shown with a double-dashed line in FIG. 1.

Specifically, referring to FIG. 6A, the recording sheet 2 is conveyed to the second sheet-feeding unit 8 in a state where the second pressing roller 10 is not in press-contact with the second sheet-feeding roller 9. When the front end 2*a* passes the second sheet-feeding unit 8, the second pressing roller 10 is lowered slowly within a time period T1 so as to gradually press the recording sheet 2 against the second sheet-feeding roller 9 rotating counterclockwise.

Accordingly, this prevents the front end 2*a* of the recording sheet 2 from hitting against the second sheet-feeding roller 9 and the second pressing roller 10, and also prevents the conveying load applied to the recording sheet 2 from changing drastically, which is caused when a rotational load of the second pressing roller 10 is suddenly applied to the recording sheet 2 being conveyed.

Consequently, this prevents printing errors, such as an undesirable line on the printed image, which may be caused when the ink in the ink ribbon is transferred to the recording sheet 2 in a partially overlapping manner due to a temporary stopping of the recording sheet 2 during the printing operation.

During the printing operation, the recording sheet 2 being pressed gradually against the second sheet-feeding roller 9 by the second pressing roller 10 is conveyed further in the direction of the arrow A so that the predetermined image can be printed onto the recording sheet 2. The recording sheet 2 being printed is conveyed downstream in the direction of the arrow A temporarily by both the first and second sheet-feeding units 5, 8. On the other hand, referring to FIG. 2, before at least a rear end 2*b* of the recording sheet 2 passes the first sheet-feeding unit 5, the first pressing roller 7 is lifted to a position corresponding to the dimension C that is greater than the thickness of the recording sheet 2.

Referring to FIG. 6A, the first pressing roller 7 is lifted slowly within a time period T2 so as to gradually move out of contact with the recording sheet 2 being conveyed in the direction of the arrow A.

By allowing the press contact force of the first pressing roller 7 to be released gradually from the recording sheet 2, the rotational load of the first pressing roller 7 applied to the recording sheet 2 is gradually reduced. This prevents a momentary increase in the conveying rate of the recording sheet 2. Furthermore, since the first pressing roller 7 is already out of press-contact with the recording sheet 2 when the rear end 2*b* of the recording sheet 2 passes the first sheet-feeding unit 5, a momentary increase in the conveying rate of the recording sheet 2 being conveyed can be prevented.

Accordingly, the image printed on the recording sheet 2 is prevented from printing errors, such as a white line.

When the printing operation of the predetermined image on the recording sheet 2 conveyed downstream in the direction of the arrow A by the second sheet-feeding unit 8 is completed, the thermal head 4 is shifted away from the platen roller 3 so that the thermal head 4 becomes in a head-up state, as shown in FIG. 3. Moreover, the second sheet-feeding roller 9 is rotated clockwise so that the recording sheet 2 is back-fed upstream in the direction of the arrow B.

In this case, the first sheet-feeding roller 6 of the first sheet-feeding unit 5 is also rotated clockwise while the first pressing roller 7 is in a lifted state.

Subsequently, when the rear end 2*b* of the recording sheet 2 being back-fed in the direction of the arrow B passes the first sheet-feeding unit 5 having the first pressing roller 7 lifted to the position corresponding to the dimension C, the first cam 14 is rotated by the first gear 15. Accordingly, as shown in FIG. 6B, the first pressing roller 7 is lowered slowly within a time period T3 so as to gradually press the recording sheet 2 against the first sheet-feeding roller 6.

In this case, due to the fact that the first sheet-feeding roller 6 is rotating clockwise, the recording sheet 2 gradually comes into press-contact with the first pressing roller 7 as the first pressing roller 7 is slowly lowered. Accordingly, this prevents the recording sheet 2 being back-fed from deviating from the conveying path.

Furthermore, referring to FIG. 4, the second pressing roller 10 is slowly shifted away from the recording sheet 2 within a time period T4 before the front end 2*a* of the recording sheet 2 being back-fed in the direction of the arrow B passes the second sheet-feeding unit 8. Thus, the press contact force is gradually released from the recording sheet 2 being back-fed.

Accordingly, this prevents the conveying rate of the recording sheet 2 being back-fed from fluctuating, and moreover, achieves a high-accuracy back-feeding operation of the recording sheet 2 without deviation from the conveying path. The sheet-feeding mechanism 1 of the printer according to the present invention is capable of performing a high-accuracy conveying operation of the recording sheet 2 at a constant conveying rate during the printing operation, and moreover, is also capable of performing a high-accuracy back-feeding operation. For this reason, in a case where a color printing operation, for example, is performed in which the recording sheet 2 is repetitively fed in the direction of the arrow A and is repetitively back-fed in the direction of the arrow B, the sheet-feeding mechanism 1 can prevent printing errors such as color displacements.

Alternatively, the press contact force of the first sheet-feeding unit 5 may be gradually released from the recording sheet 2 just as the second sheet-feeding unit 8 nips the front end 2*a* of the recording sheet 2 being printed. In other words, the recording sheet 2 being printed may be conveyed downstream in the direction of the arrow A by at least the second sheet-feeding unit 8.

As a further alternative, during the back-feeding operation of the recording sheet 2, the press contact between the second sheet-feeding roller 9 and the second pressing roller 10 may be gradually released just as the rear end 2*b* of the recording sheet 2 passes the first sheet-feeding unit 5 to become nipped between the first sheet-feeding roller 6 and the first pressing roller 7. In other words, the recording sheet 2 may be back-fed by at least the first sheet-feeding unit 5.

What is claimed is:

1. A sheet-feeding mechanism of a printer, comprising:

a first sheet-feeding unit including a first sheet-feeding roller and a first pressing roller that is press-contactable with the first sheet-feeding roller, and a first gear;

a second sheet-feeding unit including a second sheet-feeding roller and a second pressing roller that is press-contactable with the second sheet-feeding roller, and a second gear;

a recording sheet which is conveyable by being nipped between the first sheet-feeding roller and the first pressing roller and between the second sheet-feeding roller and the second pressing roller and by rotating the first and second sheet-feeding rollers; and a printing unit which is capable of printing a predetermined image on the recording sheet, wherein the first sheet-feeding unit is disposed upstream of the printing unit with respect to a direction in which the recording sheet is conveyed during a printing operation, wherein the second sheet-feeding unit is disposed downstream of the printing unit with respect to the conveying direction of the recording sheet, wherein the first gear and the second gear are meshed with each other, wherein the second pressing roller is disposed distant from the second sheet-feeding roller at the start of the printing operation, the start of the printing operation being a state where the recording sheet nipped between the first sheet-feeding unit and the first pressing roller is conveyed to the printing unit, wherein when a front end of the recording sheet being printed is conveyed to a space between the second sheet-feeding roller and the second pressing roller disposed distant from each other, the second pressing roller gradually comes into press-contact with the second sheet-feeding roller via a second lever slidable on an outer periphery of a second cam integrated with a second gear so as to nip the recording sheet such that the recording sheet being printed is conveyed downstream by at least the second sheet-feeding unit, and the first pressing roller is gradually shifted away from the first sheet-feeding roller via a first lever slidable on an outer periphery of a first cam integrated with the first gear before a rear end of the recording sheet being printed passes the first sheet-feeding unit, wherein when the printing operation performed on the recording sheet conveyed downstream by the second sheet-feeding unit is completed, the second sheet-feeding roller is reversely rotated in order to back-feed the recording sheet upstream, wherein when the recording sheet is back-fed to a space between the first sheet-feeding roller and the first pressing roller disposed distant from each other, the first pressing roller gradually comes into press-contact with the first sheet-feeding roller via the first lever slidable on the outer periphery of the first cam integrated with the first gear so as to nip the recording sheet such that the recording sheet is back-fed by at least the first sheet-feeding unit, and wherein the second lever slidable on the outer periphery of the second pressing roller is gradually shifted away from the second sheet-feeding roller via the second cam integrated with the second gear before the front end of the recording sheet being back-fed passes the second sheet-feeding unit and wherein the first pressing roller is linked to a first lever that slides on an outer periphery surface of the first cam, and wherein the second pressing roller is linked to a second lever that slides on an outer periphery surface of the second cam.

2. The sheet-feeding mechanism of the printer according to claim 1, wherein the first and second pressing rollers are capable of being shifted away from the respective first and second sheet-feeding rollers by a distance greater than a thickness of the recording sheet.

3. The sheet-feeding mechanism of the printer according to claim 1, wherein a driving source of the first and second sheet-feeding rollers is defined by a stepper motor, and wherein a conveying distance of the recording sheet is controllable by adjusting the number of steps of the stepper motor.

* * * * *